US008602291B2

(12) United States Patent
Adeline et al.

(10) Patent No.: US 8,602,291 B2
(45) Date of Patent: Dec. 10, 2013

(54) PACKAGING FOR FOOD PRODUCT WITH JACKET SURROUNDING A RECEPTACLE CLOSED BY A LID, AND ITS METHOD OF MANUFACTURE

(75) Inventors: Laurence Adeline, Agonac (FR); Christian Ott, Oberguenzburg (DE)

(73) Assignee: Bongrain SA, Viroflay (FR)

( * ) Notice: Subject to any disclaimer, the term of this patent is extended or adjusted under 35 U.S.C. 154(b) by 461 days.

(21) Appl. No.: 12/718,284

(22) Filed: Mar. 5, 2010

(65) Prior Publication Data

US 2010/0243720 A1 Sep. 30, 2010

(30) Foreign Application Priority Data

Mar. 6, 2009 (FR) ..... 09 01028

(51) Int. Cl.
*B65D 5/42* (2006.01)
*B65D 85/00* (2006.01)
*B65B 7/28* (2006.01)

(52) U.S. Cl.
USPC ..... 229/103.2; 206/459.5; 53/471

(58) Field of Classification Search
USPC ..... 206/155, 803; 220/23.91; 426/414; 493/58, 143, 144, 145; 53/420, 487, 53/128.1, 129.1, 135.1, 136.1, 296, 298; 229/87.06, 92.3, 103.2
See application file for complete search history.

(56) References Cited

U.S. PATENT DOCUMENTS 5,092,467 A * 3/1992 Elward ..... 206/784
5,240,173 A * 8/1993 Dagostine ..... 229/103.2
5,454,209 A * 10/1995 Kikuchi ..... 53/411
5,540,381 A * 7/1996 Davis ..... 229/103.2
5,958,484 A * 9/1999 Gics ..... 426/122
6,048,558 A * 4/2000 Feldmeier et al. ..... 426/120
6,261,616 B1 * 7/2001 Simpson et al. ..... 426/119
7,935,373 B2 * 5/2011 Brackenridge et al. ..... 426/129

FOREIGN PATENT DOCUMENTS

| | | |
|---|---|---|
| DE | 7707275 | 9/1977 |
| DE | 4320758 | 1/1995 |
| GB | 1380240 | 1/1975 |
| GB | 2284585 | 6/1995 |

* cited by examiner

*Primary Examiner* — Gary Elkins
*Assistant Examiner* — Christopher Demeree
(74) *Attorney, Agent, or Firm* — Morgan, Lewis & Bockius LLP

(57) ABSTRACT

The invention relates to a packaging for a food product comprising a container with a receptacle closed by a lid and a jacket that surrounds the container and in contact with which the latter is mounted, and its method of manufacture.

Figure 1:
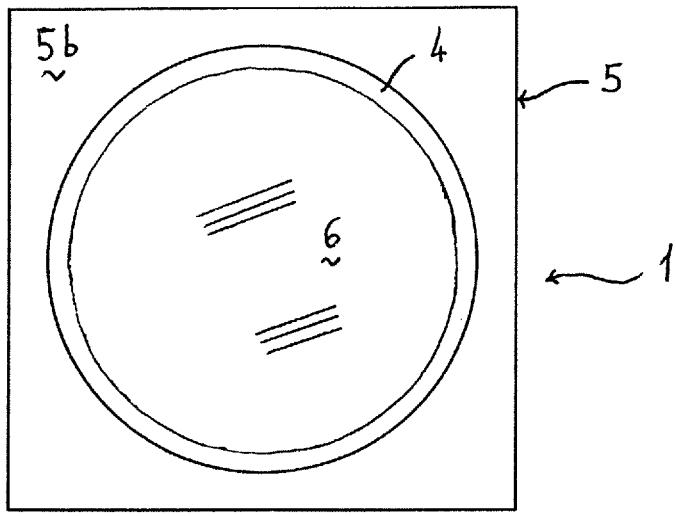

According to the invention, this lid (4) is covered with at least one element (6) for identifying the product which is pressed thereon by removal of at least one zone of the jacket of predetermined geometry and forming this element.

The packaging according to the invention is manufactured by:

a) filling the container by means of the said product, b) closure of the container, thus filled, by its lid, c) positioning of the jacket around the container so that this zone to be removed is located facing a predetermined location of the lid, then d) stamping (A) the jacket in this zone in order to press this element onto the lid, this element preferably being prespread with adhesive in order to adhere to the lid after this stamping.

9 Claims, 2 Drawing Sheets

PACKAGING FOR FOOD PRODUCT WITH JACKET SURROUNDING A RECEPTACLE CLOSED BY A LID, AND ITS METHOD OF MANUFACTURE

RELATED APPLICATIONS

The present application is a U.S. Utility Patent Application, which claims priority to French Patent Application No. 0901028 (filed Mar. 6, 2009), which is hereby incorporated by reference in its entirety.

The present invention relates to a packaging comprising a container of the type with a receptacle for a food product closed by a lid and a jacket that surrounds the container and in contact with which the latter is mounted, and a method for manufacturing this packaging.

For a long time, it has been known practice to package food products in a receptacle closed by a lid, while also providing the container thus obtained with a jacket typically made of cardboard surrounding it at its bottom, its upper face and at least on two of its opposite lateral faces, for example by hot-sealing or by bonding this jacket onto this container. It is possible, for example, to cite document GB-A-2 284 585 which shows a packaging thus obtained.

A major drawback of these known packagings with a jacket surrounding a closed container lies in the necessity to individualize each container specifically as a function of the product that it is intended to contain, by the operation of labelling its lid and/or receptacle, which represents a relatively high cost for manufacturing the containers.

One object of the present invention is to propose a packaging comprising a container for a food product of the type with a receptacle closed by a lid, and a jacket that surrounds the container and in contact with which the latter is mounted, which remedies this drawback.

Accordingly, a packaging according to the invention is such that this lid is covered with at least one element for identifying the product that is pressed thereon by removal of at least one zone of the jacket of a predetermined geometry and forming the or each element.

"Receptacle" and "lid" mean, in the present description, respectively a support for the food product comprising a bottom and optionally a lateral wall (this receptacle can be without the lateral wall in the case of a base or a tray receiving this product), and a closure means for this support which may be of the lid type that is substantially flat or else with a lateral wall (i.e. a cloche in the latter case).

It will be noted that this packaging according to the invention makes it possible to use containers that are initially "neutral" in appearance, i.e. having no inscription or label even for different products that they are intended to contain, by virtue of the use of the jacket itself to identify each product by transferring one or more predetermined zones of this jacket to the wall of the container in the location of its lid and optionally of the lateral wall of the receptacle that it encloses.

It will also be noted that the container can be covered with a plurality of distinct identification elements originating from this jacket, or else with only one identification element designed to form a commercial label applied to this container.

Preferably, the container is covered with a single identification element pressed onto its lid by stamping the jacket in the location of the said corresponding zone, which is located substantially in the centre of an upper face of the jacket where this zone has been removed. Advantageously, this stamping is carried out in an automated manner, it being specified that it would also be possible to cut out this identification element in another way before attaching it to the lid.

Yet more preferably, this identification element formed by the said jacket zone forms a label for the lid which extends substantially over the whole surface of the latter towards the inside and below a peripheral rim of the lid that is clipped onto the receptacle, this rim preferably having a plurality of recesses evenly spaced over the periphery of a shoulder of this rim against which this element is placed.

Note that these recesses make it easier to position the identification element against the rim of the lid.

According to another feature of the invention, the said or each identification element can be attached to the lid by mechanical or adhesive means, this element preferably being pre-spread with adhesive in order to adhere to the lid following the aforementioned stamping, forming a label identifying the product contained in the container.

According to another feature of the invention, the wall of the jacket comprises a bottom receiving the receptacle and an upper face opened by the removal of the said zone that are connected together by two opposite lateral faces, this wall being suitable for immobilizing the container in the jacket.

According to another feature of the invention, means for holding the container in the jacket may advantageously be formed on the said wall of the latter, and being located:

- on a peripheral region of the inner side of the said upper face surrounding the said removed zone, by a sealing or bonding of this inner region onto a peripheral rim of the lid, and/or
- on the said bottom by at least two immobilizing flaps that are respectively articulated by two opposite lower edges of this bottom connecting the said lateral faces together and that are each suitable for closely fitting a portion of the lateral wall of the receptacle while being folded down towards the inside of the jacket.

Advantageously, the lateral wall of the receptacle may have symmetry of revolution, for example at least partly frusto-conical, and the lid is in this case circular of the type clipped onto this lateral wall, the jacket in this case preferably having a substantially parallelepipedal geometry and the said holding means comprising these two flaps the respective free edges of which are cut away in an arc of a circle so as to closely fit the contour of this lateral wall in order to immobilize the receptacle with respect to the two lateral faces of the jacket.

According to another feature of the invention, the jacket may advantageously be made of cardboard that is folded and sealed by covering its bottom with a strip of sealant extending over one side of the said bottom, and the container may be made of at least one plastic (for example of two different flexible thermoplastics for the lid and for the receptacle).

As indicated above, the jacket may have a substantially parallelepipedal geometry gripping the container which preferably has symmetry of revolution and for example has a circular radial section. It will be noted however that other non-circular geometries may be used both for the lid and for the receptacle that it closes, elliptical or polygonal (for example rectangular or square) sections also being able to be envisaged for the container.

A manufacturing method according to the invention of a packaging as defined above comprises successively:

a) a filling of the container by means of the said product, b) a closure of the container, thus filled, by its lid, c) a positioning of the jacket around the container thus closed so that the said or each zone of the jacket to be removed which comprises the said or each identification element is located facing a predetermined location of the lid, then d) a stamping of the jacket thus positioned in the location of the or each zone in order to press the or each identification element onto the lid, this element preferably being pre-spread with adhesive in order to adhere to the lid after this stamping.

Figure 2:
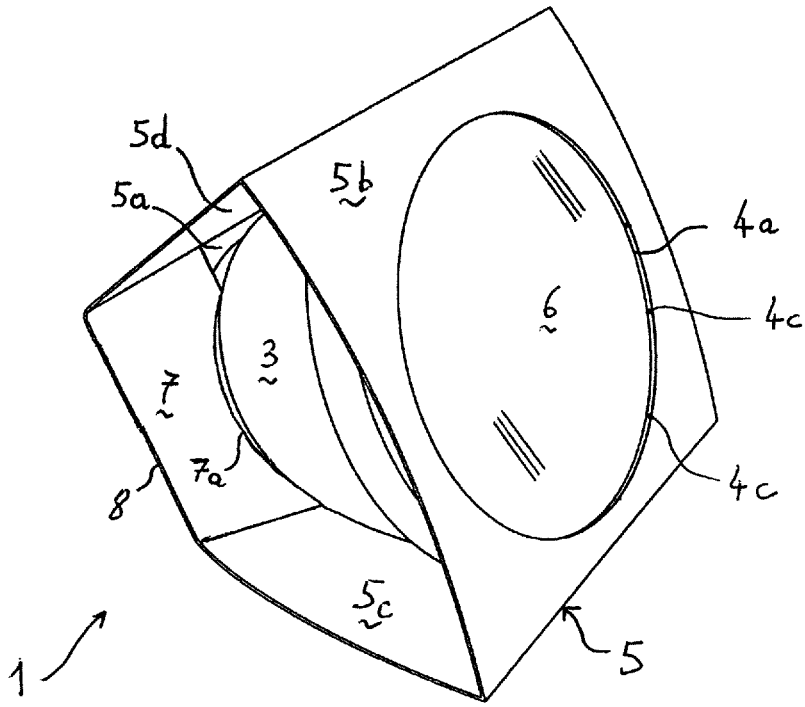
Figure 3:
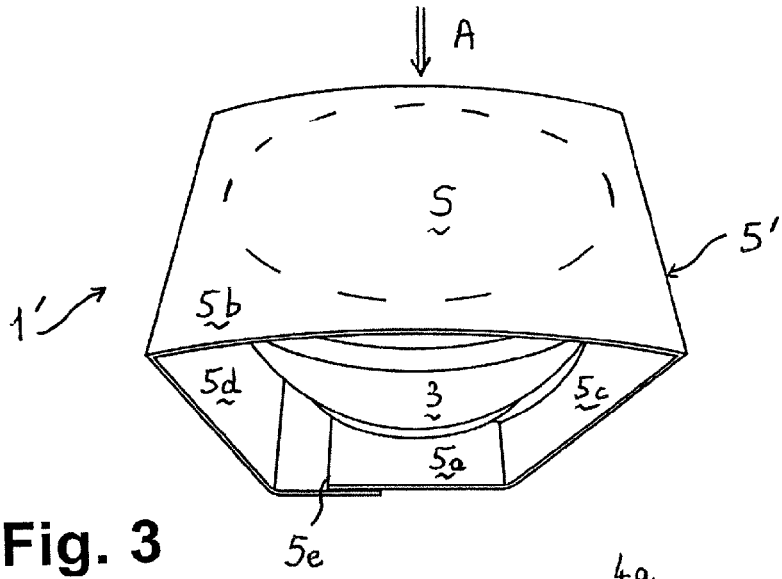
Figure 4:
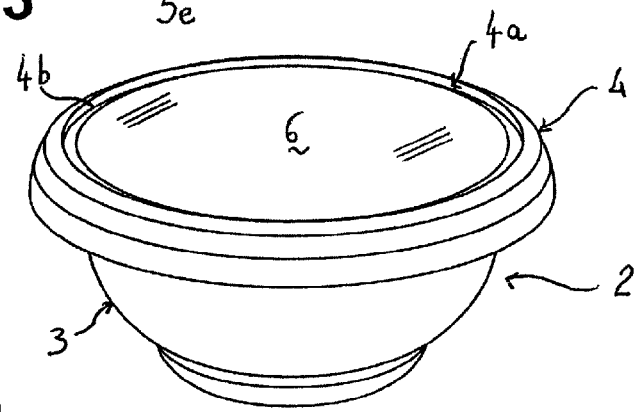
Figure 5:
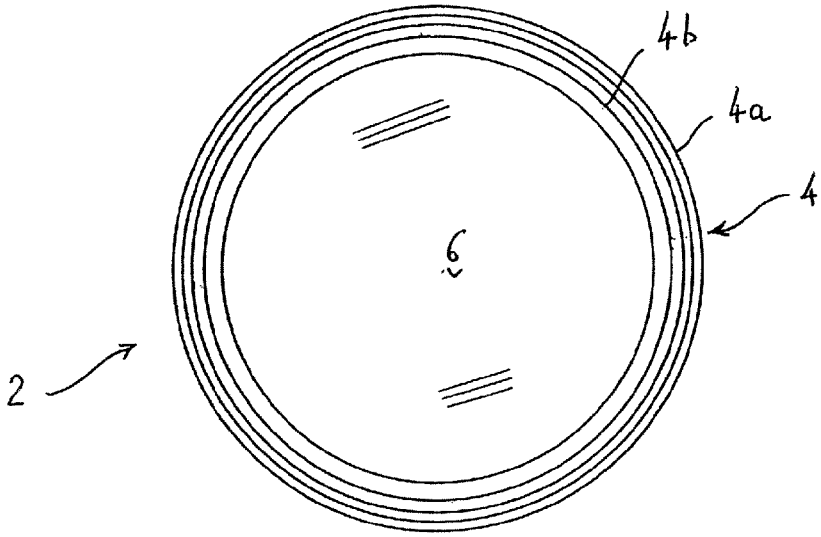

Other features, advantages and details of the present invention will emerge on reading the following description of several exemplary embodiments of the invention, given as an illustration and not being limiting, the said description being made with reference to the attached drawings, amongst which:

FIG. 1 is a schematic top view of a packaging according to the invention,

FIG. 2 is a view in perspective of the packaging of FIG. 1 according to one exemplary embodiment of the invention, FIG. 3 is a view in perspective of the packaging of FIG. 1 during manufacture, according to another exemplary embodiment of the invention corresponding to a variant of FIG. 2, FIG. 4 is a view in perspective of a container with lid that can be used in the packagings of FIGS. 2 and 3, and FIG. 5 is a top view of the container of FIG. 4 showing the detail of the structure of the lid that it comprises.

The packaging 1,1' preferably illustrated in FIGS. 1 to 5 contains for example a cheese or a cheese specialty, it being specified that it could contain any other food product. This packaging 1 comprises, on the one hand, a container 2 which is filled with this product and which consists of a receptacle 3 closed by a lid 4 and, on the other hand, a jacket 5, 5' which surrounds the container 2 and in contact with which the latter is mounted.

In the exemplary embodiments illustrated, the jacket 5,5' has a parallelepipedal geometry gripping the container 2, which has symmetry of revolution with a circular radial section both for the receptacle 3 which is for example tapered along several generally frustoconical sections and for the lid 4 which is flat, with the exception of a peripheral rim 4*a* being clipped to a peripheral edge of the receptacle 3. The latter and the lid 4 are for example made of two different flexible thermoplastics.

As illustrated in FIGS. 2 and 3, the jacket 5, 5', made of folded cardboard, comprises essentially a bottom 5*a* receiving that of the receptacle 3 and an upper face 5*b* opened in its centre which are connected together by two opposite lateral faces 5*c* and 5*d*, so that the other two opposite sides of the jacket 5, 5' are open (at least partly) in order to make it possible to extract the container therefrom and to reposition it therein after use. This jacket 5, 5' is also sealed onto itself at its bottom by a strip of sealant 5*e* (visible in FIG. 3) extending along one side of the bottom 5*a*.

According to the invention, the upper face 5*b* of the jacket 5, 5' is opened by stamping (see arrow A in FIG. 3) a predetermined zone S of the latter (identified in dashed lines in this figure) designed to form a label 6 for identifying the product contained in the container 2, after filling, closure and precise positioning of the latter beneath this upper face 5*b* to be stamped (this label 6 is symbolized by hatchings in FIGS. 1, 2, 4 and 5). This stamping is advantageously carried out by an automated-control piston, and it therefore has the effect of transferring to the container 2 the label 6 previously integrated into the jacket 5, 5' by pressing it by bonding onto the outer face of the lid 4, for example over the whole surface of the latter as can be seen in FIGS. 1 to 5. Accordingly, the label 6 can have adhesive previously applied for instantaneously adhering to the lid 4 at the time of this stamping.

As can be seen in FIGS. 4 and 5, the rim 4*a* of the lid 4 is connected to the flat surface of the latter receiving the label 6 by a shoulder 4*b* which forms a vertical peripheral abutment for the latter and which has recesses 4*c* (see FIG. 2) evenly spaced in order to make the label 6 easier to position when it is applied to the lid 4.

The packaging 1 according to the invention also comprises (see FIGS. 2 and 3) means for holding the container 2 in the jacket 5, 5' that are formed on the wall of the latter by being, for example, obtained by a bonding, onto the rim 4*a* of the lid 4, of a peripheral region (not visible) of the inner side of its upper face 5*b* surrounding the orifice of the latter resulting from the stamping of the zone S.

In the example of FIG. 2, these holding means also comprise two flaps 7 for immobilizing the receptacle 3 (a single flap 7 can be seen) which are respectively articulated on two opposite lower edges 8 of the bottom 5*a* of the jacket 5 connecting its lateral faces 5*b* and 5*c* together and which each have their free edges 7*a* cut away in an arc of a circle in order to closely fit a portion of the lateral wall of the receptacle 3 by being folded down towards the inside of the jacket 5.

It will be noted that the shape of the jacket 5, 5' of a packaging according to the invention is not limited to that illustrated in these figures and that it could be, as a variant, partially or totally closed on each of its lateral faces (i.e. in the place of the two open sides of the jacket 5, 5', which could, for example, be furnished with flaps articulated on the bottom 5*a* or on the upper face 5*b*).

The invention claimed is:

1. A food packaging product comprising a container of the type with a receptacle closed by a lid, and a jacket that surrounds the container and in contact with which the latter is mounted, the jacket comprising an upper face which surmounts the lid, wherein the lid is covered with at least one element for identifying the product that is pressed thereon by removal of at least one zone of the jacket of a predetermined geometry and forming the or each element, said at least one element being stamped, surrounded by a peripheral non-removed region of the upper face of the jacket and being located beneath said peripheral region.

2. The food packaging product according to claim 1, wherein the said or each identification element is pressed onto the lid by stamping the jacket in the location of the said zone which is located substantially in the centre of said upper face of the jacket where this zone has been removed.

3. The food packaging product according to claim 2, wherein the said or each identification element formed by the said jacket zone forms a label for the lid which extends substantially over the whole surface of the latter towards the inside and below a peripheral rim of the lid that is clipped onto the receptacle, this rim preferably having a plurality of recesses evenly spaced over the periphery of a shoulder of this rim against which this element is placed.

4. The food packaging product according to claim 1, wherein the said or each identification element is attached to the lid by mechanical or adhesive means, this element preferably being pre-spread with adhesive in order to adhere to the lid, forming a label identifying the product contained in the container.

5. The food packaging product according to claim 1, wherein the wall of the jacket comprises a bottom receiving the receptacle and said upper face opened by the removal of the said zone that are connected together by two opposite lateral faces, this wall immobilizing the container in the jacket.

6. The food packaging product according to claim 5, wherein means for holding the container in the jacket are formed on the said wall of the latter, while being obtained:

on said peripheral region of the inner side of the said upper face surrounding the said zone removed from the jacket, by a sealing or bonding of this inner region onto a peripheral rim of the lid, or on the said bottom by at least two immobilizing flaps that are respectively articulated by two opposite lower edges of this bottom connecting the said lateral faces together and that are each suitable for closely fitting a portion of the lateral wall of the receptacle while being folded down towards the inside of the jacket.

7. The food packaging product according to claim 6, the lateral wall of the receptacle having symmetry of revolution, and the lid being circular of the type clipped onto this lateral wall, wherein the jacket has a substantially parallelepipedal geometry and in that the said holding means comprise the said two flaps the respective free edges of which are cut away in an arc of a circle so as to closely fit the contour of this lateral wall in order to immobilize the receptacle with respect to the said two lateral faces of the jacket.

8. The food packaging product according to claim 1, wherein that the jacket is made of cardboard that is folded and sealed by covering its bottom with a strip of sealant extending over one side of the said bottom, and in that the container is made of at least one plastic.

9. The food packaging product according to claim 1, wherein the jacket has a substantially parallelepipedal geometry gripping the container, which has symmetry of revolution and preferably has a circular radial section.

* * * * *